United States Patent [19]

Mark et al.

[11] 3,983,447

[45] Sept. 28, 1976

[54] SWITCH AND DUAL LAMP AND SWITCH COMBINATION

[76] Inventors: Arnold Mark, 2485 Malibu Road; Donald J. Berman, 3091 Seaview Lane, both of Bellmore; Sam Cohen, 136 Beach 136 St., Bell Harbor, all of N.Y. 11710

[22] Filed: May 23, 1975

[21] Appl. No.: 580,448

[52] U.S. Cl. ..... 315/64; 200/6 R; 200/335; 313/316; 315/69

[51] Int. Cl.[2] ..... H01K 1/64

[58] Field of Search ..... 315/64, 66, 67, 69; 313/316; 200/1 A, 1 TK, 6 R, 161, 246, 283, 335, 336

[56] References Cited

UNITED STATES PATENTS

| | | | |
|---|---|---|---|
| 678,320 | 7/1901 | Miller | 315/66 |
| 931,807 | 8/1909 | Smith | 315/64 |
| 3,780,245 | 12/1973 | Beddow | 200/6 R X |
| 3,846,599 | 11/1974 | Fontaine | 200/161 X |
| 3,886,400 | 5/1975 | Dill | 315/64 |

*Primary Examiner*—Eugene La Roche
*Attorney, Agent, or Firm*—Allison C. Collard

[57] ABSTRACT

A switch, and a dual lamp and switch combination comprising two conductive strips spaced from each other and each having a contact point adjacent an upper end. The conductive strips contacting filament wires of the lamp or electrical conductors of a power line. A handle including a base is pivotably mounted relative to the contact points, and a conductive member operated by the handle, selectively contacts at least one of the contact points. The conductive member is integral with at least a portion of the conductive member and engages a metallic screw-on section of the lamp or electrical conductors of the power line.

9 Claims, 10 Drawing Figures

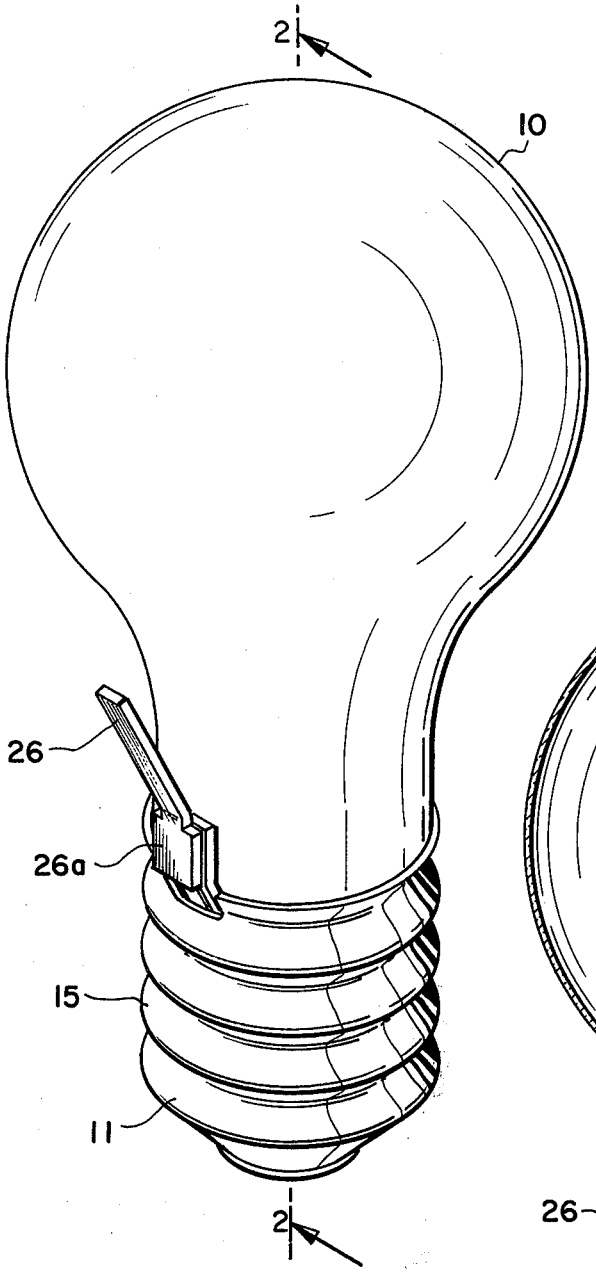
Fig. 1.
Fig. 2.
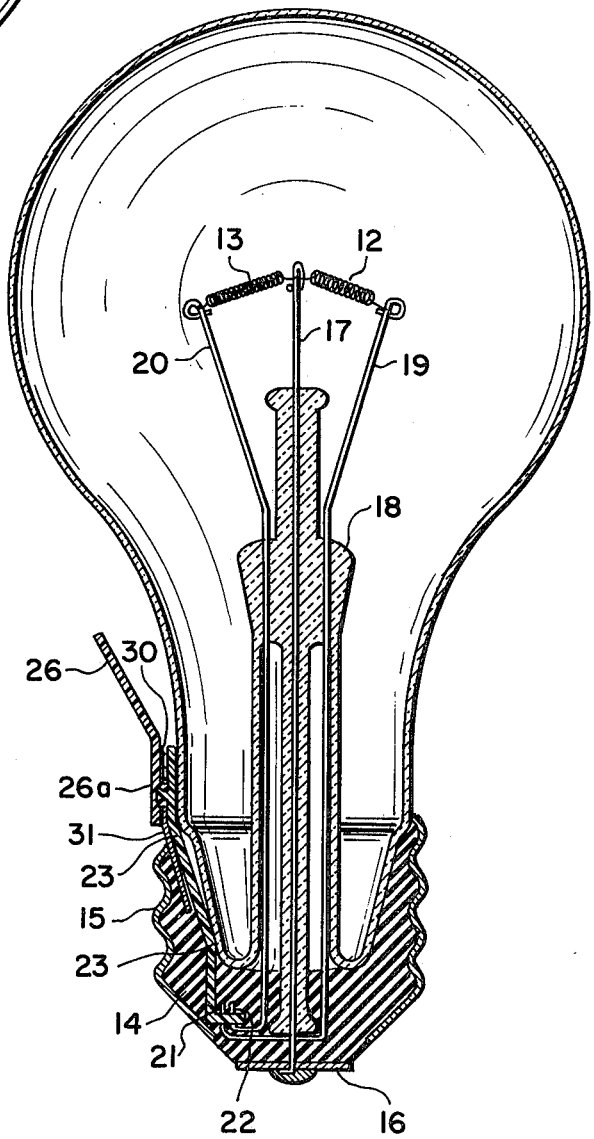

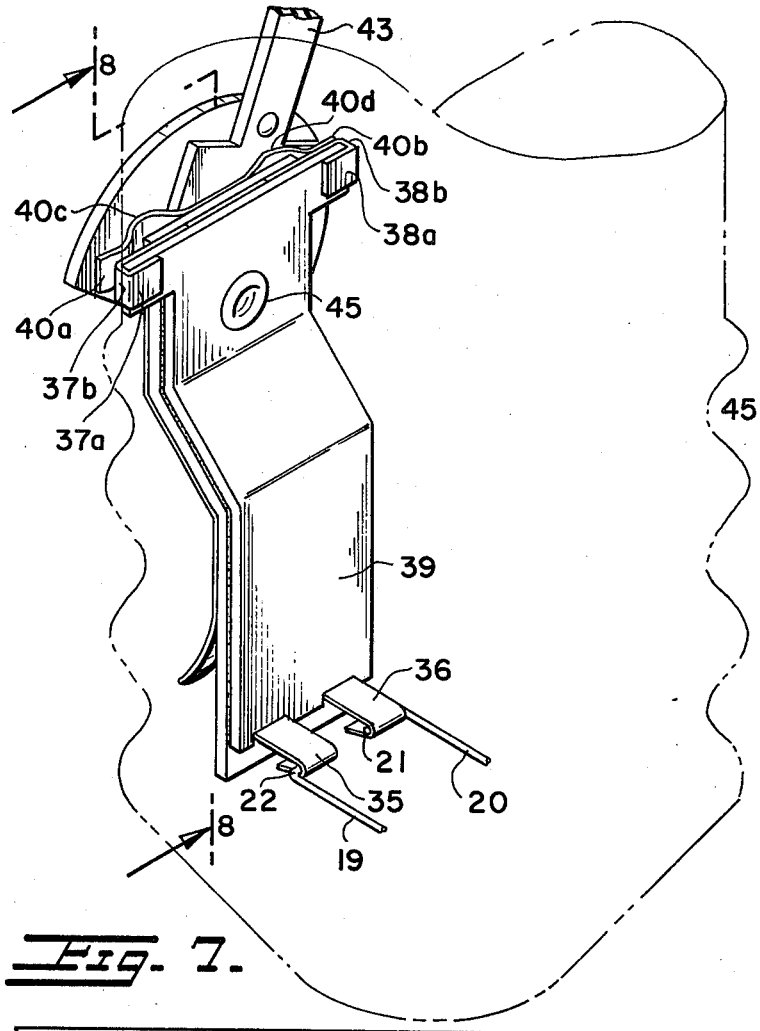
Fig. 7.
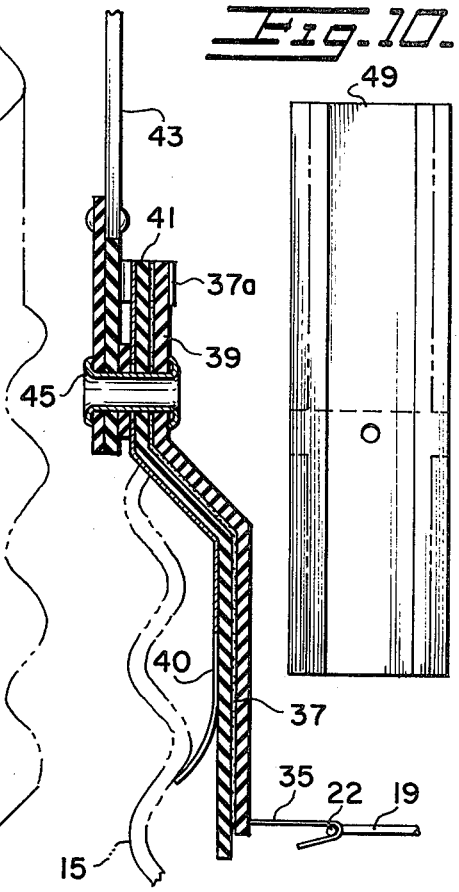
Fig. 8.
Fig. 10.
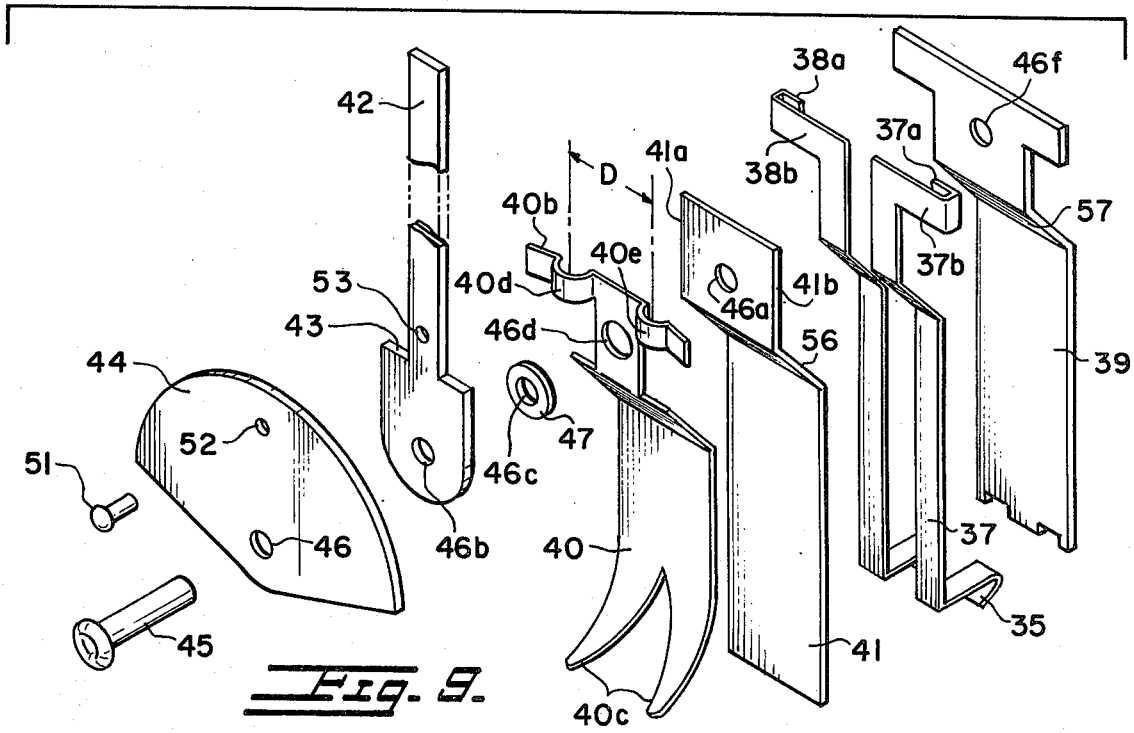
Fig. 9.

SWITCH AND DUAL LAMP AND SWITCH COMBINATION

The invention relates to switches, and to switches in combination with light bulbs. In particular the invention concerns a dual filament incandescent lamp and switch combination in which the second filament thereof is manually energized when the first filament burns out.

A simple and inexpensive, yet reliable two-way switch, for example, for use in printed circuits, e.g. TV applications, and other applications particularly for infrequent switching jobs is always desired. On another hand, conventional known three-way light bulbs have several disadvantages, for example, extra parts, such as an extra ring and a special type of socket.

Accordingly, it is an object of the present invention to provide a simple and easily manufactured inexpensive switch which constitutes and improvement to the known devices, as well as an improved switch and dual filament incandescent lamp combination which is simple in design, easy to manufacture and efficient and reliable in operation.

It is another object of the present invention to provide a two-position switch for switching power from a power line to at least one conductor, as well as a combination switch and dual filament lamp comprising at least two substantially vertically extending conductive strips spaced from each other, and each having a contact point adjacent an upper end thereof, the strips being adapted to electrically contact respective electrical conductors or filament wires of a light bulb. A handle is provided having a base, the latter being pivotably mounted with respect to the contact points. A conductive means operatively selectively contacts at least one of the contact points of the two conductive strips by pivoted movement of the handle. A conductive member is integral with at least a portion of the conductive means and is adapted to engage a metallic screw-on section of a light bulb or the power line.

It is yet another object of the present invention to provide the switch, in accordance with the above-mentioned object, wherein the two strips form substantially laterally extending tabs constituting the contact points. The conductive means constitutes two laterally extending switch portions adjacent the tabs, respectively, as well as two arc portions. The base of the handle lies adjacent the arc portions and is moveably mounted relative thereto in a range of movement abutting the arc portions. The base is dimensioned relative the arc portions so that in a first intermediate position of the handle the base presses both of the arc portions in a direction against the contact points. In a second position of the handle, the base presses only one of the arc portions in a direction against its corresponding switch portion while operatively releasing the first switch portion.

It is still another object of the present invention to provide the switch in accordance with the above-mentioned objects, wherein the conductive means has prongs as its lower end adapted to engage, for example, the metallic screw of a light bulb. The base of the handle has a width substantially equal to the distance of the centers of the arc portions from each other, and an insulating member is disposed between the conductive means and the two conductive strips. The switch portions and the contact points overlap the insulating member.

Other objects and features of the present invention will become apparent from the following detailed description when taken in connection with the accompanying drawings which disclose several embodiments of the invention. It is to be understood that the drawings are designed for the purposes of illustration only, and are not intended as a definition of the limits and scope of the invention disclosed.

In the drawings, wherein similar reference numerals denote similar elements throughout the several views:

FIG. 1 is a perspective view of a switch and dual filament incandescent lamp combination in accordance with the present invention;

FIG. 2 is a section taken along the lines 2—2 of FIG. 1;

FIG. 7 is a perspective view of another embodiment of a switch in accordance with the present invention;

FIG. 8 is a section along the lines 8—8 of FIG. 7;

FIG. 9 is an exploded view of the switch of FIG. 7; and

FIG. 10 is an elevation view of a vapor deposited combination part as a variant for use with the switch of FIG. 7.

Figure 3:
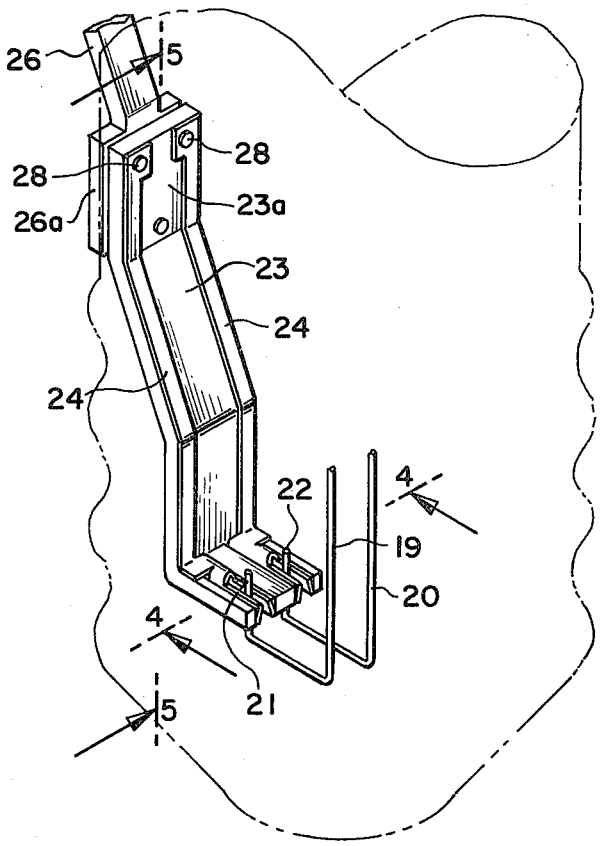
FIG. 3 is a perspective view of a switch in accordance with the present invention.
Figure 4:
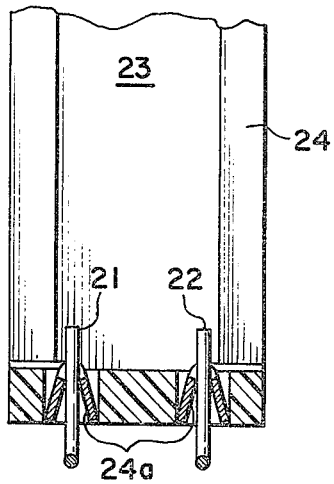
FIG. 4 is a section taken along the lines 4—4 of FIG. 3.

Referring now to the drawings, and more particularly to FIGS. 1—6, an incandescent lamp is illustrated having a glass envelope 10 and base 11. The lamp includes a first filament portion 12 and a second filament portion 13, filament portions 12 and 13 preferably being a single filament which is center tapped to form two equal half portions. If the bulb is designed for 120 volt operation, the filament can consist of a 240 volt filament which is center tapped. Base 11 consists of electricl insulation material 14, which may, for example, be epoxy, a conductive metallic screw-on section 15 surrounding the insulation material 14 and forming the sides of the lamp base, and a conductive metallic section 16 disposed on the bottom of the electrical insulation material and forming the bottom of the base. Filament portions 12 and 13 are connected to conductive section 16 by common wire 17 which is disposed through solid glass cylindrical projection 18 formed within the glass envelope 10.

Wires 19 and 20 are connected respective to ends of filament portions 12 and 13 and are disposed through cylindrical portion 18, the wires being crimped at their free ends 21 and 22, respectively, into electrical contact with conductive strips 24 of member 23. The member 23 is disposed in insulation material 14 of the lamp and extends upwardly along the outside of glass envelope 10. The conducting strips 24 are preferably made of copper and the member 23 of plastic.

Ends 21 and 22 of wires 19 and 20 frictionally engage in the tapered V-shaped slots 24a of strips 24, having been wedged in the narrowmost portions of the slots. In this manner, wires 19 and 20 and thus the respective filament portions 12 and 13 are electrically connected to a corresponding conductive strip 24.

Figure 5:
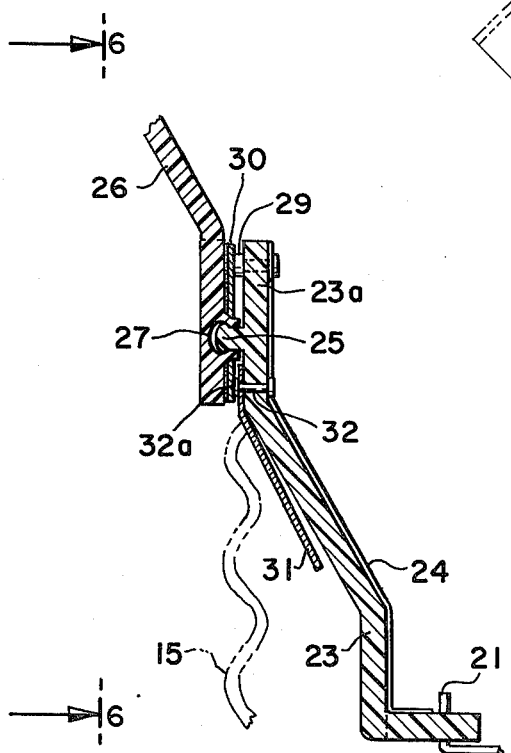
FIG. 5 is a section taken along the lines 5—5 of FIG. 3.

The conductive strips 24 are riveted at their top portions to member 23, rivets 28 being made of an electrically conducting material so as to constitute electrical contact points 29 on the side of the member 23 facing away from the glass envelope, as shown in FIG. 5. Member 23 has an upper vertical portion 23*a* which is formed with a pivot 25 projecting laterally in a direction away from glass envelope 10. A pivotable handle 26 having a base 26*a* is formed with a corresponding recess 27, which pivotably engages pivot 26 together forming a snap-in joint. Members 25 and 26 are preferably made of a plastic non-conducting insulated material.

An electrically conductive member 30, preferably a metal copper layer, is disposed over base 26*a* of handle 26 adjacent contacts 29. Base 26*a* is substantially the same as the size of the upper vertical portion 23*a* of member 23. An electrically conductive member 31 extends downwardly from the outside of the upper portion 23*a* of member 23 and is secured thereon by a rivet 32 or the like, the latter forming an electrical contact point 32*a* at its head which faces away from the lamp. Member 31 is in continuous electrical contact with the conductive metal section 15 of the lamp as well as in continuous electrical contact with conductive member 30, for all positions (FIG. 6) of handle 26, since contact point 32*a* always presses against the electrically conductive member 30. Recesses 27 which is formed on the lower half of the member 26*a* aides this pressing by gravity.

Figure 6:
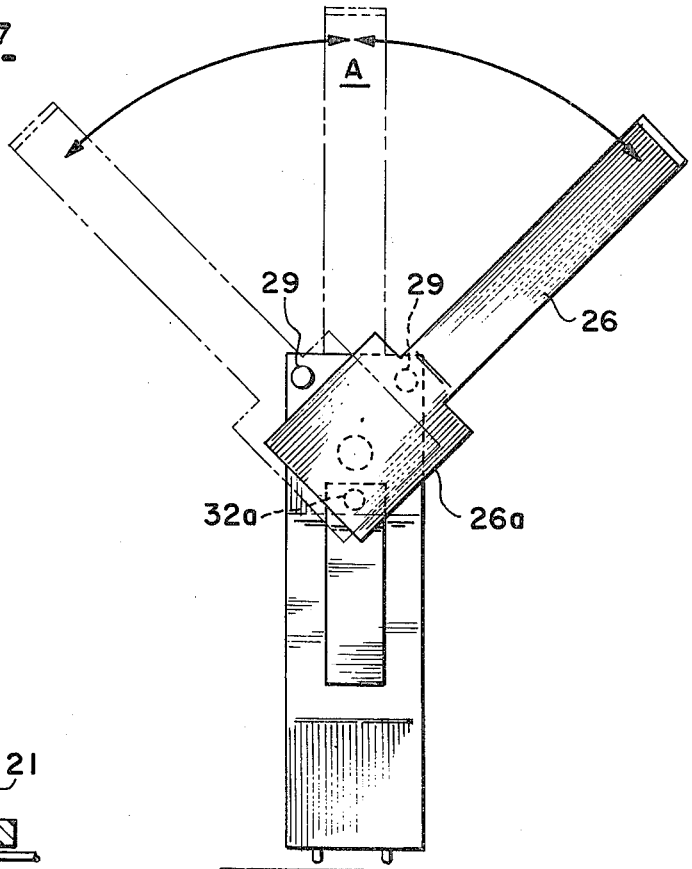
FIG. 6 is a section taken along the lines 6—6 of FIG. 5; showing the handle in several positions of use.

Handle 26 may be pivoted into three operative positions as indicated by the arrow at the top portion of FIG. 3 as well as the double-ended arrows in FIG. 6. When handle 26 is in the center vertical position A, electrically conductive member 30 makes contact with both contacts 29, thus placing both wires 19 and 20 and filaments 12 and 13 in electrical contact with the conductive metallic section 15 of the lamp. Thus when the lamp is turned "on" and handle 26 is in the position A, both filaments 12 and 13 are lit.

When handle 26 is rotated to either the right hand or left hand position of FIG. 6, then only one of the respective contacts 29 makes electrical contact with member 30. As a result, only the corresponding filament 12 or 13 of the lamp lights. Base portion 26*a* of handle 26 and likewise conductive portion 3 is dimensioned such that on rotation to either the right or left hand position, only one of the electrical contacts 29 abuts conductive member 30.

Reference is now made to FIGS. 7—9 for another embodiment of a switch in accordance with the present invention. Wires 19 and 20 in the lamp are similar to that shown and described with respect to the previous figures and are not again described. Ends 21 and 22 of wires 19 and 20 are crimped on tabs 35 and 36 respectively of electrically conducting strips 37 and 38. A member 39, preferably made of bakelite insulating paper (30 pound Kraft paper base) which can withstand high temperature and is fire-proof, covers conductive strips 37 and 38 at one side. The upper portion of strips 37 and 38 extend laterally and are folded over the top portion of member 39 at tab portions 37*a* and 38*a*. The back portions 37*b* and 38*b* of the tab portions constituting contact points are adapted to be in selective switchable electrical contact with upper switch portions 40*a* and 40*b* respectively, of an electrically conductive member 40 of the switch. Between electrically conductive member 40 and conductive strips 37 and 38, there is sandwiched another insulating member 41, preferaby made of bakelite insulating paper. Electrical contact portions 40*a* and 40*b* extend beyond the lateral edges 41*a* and 41*b* of the insulating member 41 for operative selective contact, as hereinafter explained, with back portions 37*b* and 38*b*, respectively of tabs 37*a* and 38*a* of the electrically conductive strips 37 and 38.

The electrically conductive member 40 as shown in FIG. 8 is formed with prongs 40*c* which make electrical pressure contact with the metallic conductive section 15 of the lamp. A handle 42 is provided having a base 43. The handle 42 is connected to a sector-shaped insulation shield 44, by a pin 51 passing through bores 52 and 53 in the shield and handle respectively. The shield 44 protects people from electrical shock as a result of an inadvertent touching of portions 40*a* and 40*b*. In this respect, plate 44 extends beyond the exterior edges of the switch contact portions 40*a* and 40*b* as may be seen in FIG. 7.

The elements of the switch are held together by a single rivet 45 or bolt and nut combination passing through bores 46*a*, 46*b*, 46*c*, 46*d*, 46*e*, and 46*f* in the respective members as shown in FIG. 7. Washer 47 rotatably mounts the handle 42 relative to member 40. Members 39, 40 and 41 are formed with upper and lower portions jointed by inclined portions 55, 56 and 57, respectively, which prevent relative rotation of the respective members. Bores 46*d*, 46*e* and 46*f* of these members are formed in their upper portions.

Base 43 of the handle 42 is sufficiently dimensioned and oriented so that it abuts arc portions 40*d* and 40*e* of member 40. The width of the base 43 is preferably slightly larger than the center to center distance D between arc portions 40*d* and 40*e*.

In operation, handle 42 has three operative positions: In a center vertical position of the handle, base 43 presses against both arcs 40*d* and 40*e*. This causes both contact members 40*a* and 40*b* to electrically contact the respective conductive back portions 37*b* and 38*b* of tabs 37*a* and 38*a* of conductive strips 37 and 38, thereby making electrical contact with the wires 19 and 20 through the strips 37 and 38, the member 40 and the metallic contacting section 15 of the lamp. As a result, both filaments are lit when the lamp is "on" and handle 42 is vertical.

When handle 42 is pivoted to the right or left, then base 43 presses only one arc portion, for example, arc portion 40*d* as shown in FIG. 7, and releases other arc portion 40*e*. This action causes a "see-saw" type effect, pressing down arc portion 40*d*, making electrical connecting between the contact member 40*b* and back portion 38*b* of tab 38*a*, while forcing other arc portion 40*e* to be raised in a direction spaced apart from back portion 37*b* of the contact tab 37*a*. This breaks any operative electrical connection between the wire 19 and metallic conductive section 15. In this case, only the filament 13 connected to the line 20 is activated when the lamp is "on", while the filament 12 is not lit.

In like manner, when handle 42 is shifted to the left hand position of FIG. 7, the reverse effect occurs and only filament 12 is activated when the lamp is "on". Member 31 or prongs 40*c*, can be connected to a power line since electrical power will be directly connected to switch conductor lines if the switch is used, e.g. in a printed circuit, as used in TV or other applications, as an inexpensive, yet reliable two-way switch.

FIG. 10 shows vapor deposited bakelite member 49 which serves as a combination member for elements 37, 38, and 39 of FIG. 9. Copper vapor is deposited on the bakelite paper and then peeled off to form two conducting strips, similar to strips 37 and 38 of FIG. 6. Member 49 is folded over at the dashed fold lines and a rivet hole is provided in the center.

While only a few embodiments have been shown and described, it will obvious that many changes and modification may be made thereunto without departing from the spirit and scope of the invention.

What is claimed is:

1. A two-position switch for switching power from a power line to at least one conductor comprising:

at least two substantially vertically extending conductive strips spaced from each other, and each having a contact point adjacent an upper end thereof, said strips adapted to electrically contact respective electrical conductors;

said two strips form substantially laterally extending tabs forming said contact points;

a handle having a base, the latter being pivotably mounted with respect to said contact points;

conductive means for operatively selectively contacting at least one of said contact points of said at least two conductive strips by a pivotal movement of said handle;

said conductive means forming two laterally extending switch portions adjacent said tabs, respectively and two arc portions a conductive member integral with at least a portion of said conductive means and adapted to engage the power line; and said base of said handle being mounted adjacent said arc portions moveable relative thereto in a range of movement pressingly abutting said arc portions, alternately and simultaneously, respectively, in a direction toward said contact points so that the corresponding switch portions engage the corresponding contact points, and, so that when said base presses alternately one of said arc portions, the other arc portion moves by see-saw action in a direction away from the corresponding contact point.

2. The switch, as recited in claim 1, wherein said conductive means including prongs at its lower end, said base of said handle has a width substantially equal to the distance of the centers of said arc portions from each other;

an insulating member disposed between said conductive means and said two conductive strips; and said switch portions and said contact points overlapping said insulating member.

3. The switch as recited in claim 2, wherein said two conductive strips constitute an integral part of a second insulating member.

4. The switch, as recited in claim 3, further comprising:

means for holding all of said members aligned in position and for rotatably mounting said handle relative thereto.

5. A combination switch and multiple filament light bulb, comprising:

a light bulb having a glass envelope enclosing at least two filaments and a base insulating material, the latter being surrounded by a metallic screw-on section;

a first wire and a second wire extending from said at least two filaments, respectively, into said base insulating material;

at least two substantially vertically extending conductive strips spaced from each other and disposed in said base insulating material and extending upwardly out of the latter along said glass envelope, and each strip having a contact point adjacent an upper end thereof, said strips at a bottom thereof being electrically connected to said first and second wires of said light bulb, respectively;

a center conductive section connected with said base insulating material and insulated thereby from said metallic screw-on section;

a third wire connecting said filaments to said center conductive section;

a handle having a base, the latter being pivotably mounted with respect to said contact points;

conductive means for operatively selectively contacting at least one of said contact points of said at least two conductive strips by a pivotal movement of said handle; and a conductive member integral with at least a portion of said conductive means and adapted to engage said metallic screw-on section of said light bulb.

6. The combination switch and multiple filament light bulb as recited in claim 5 wherein:

said two strips form substantially laterally extending tabs forming said contact points;

said conductive means forming two laterally extending switch portions adjacent said tabs, respectively, and two arc portions; and said base of said handle being mounted adjacent said arc portions and moveable relative thereto in a range of movement pressingly abutting said arc portions alternately and simultaneously, respectively in a direction towards said contact points, respectively, so that said switch portions engage corresponding contact points, and so that when said base presses alternately one of said arc portions, the other arc portion moves by see-saw action in a direction away from its corresponding contact point.

7. The combination switch multiple filament light bulb, as recited in claim 6 wherein said conductive means include prongs at its lower end engaging said metallic screw-on section of said light bulb;

said base of said handle having a width substantially equal to the distance between centers of said arc portions;

an insulating member disposed between said conductive means and said two conductive strips; and said switch portions and said contact points overlapping said insulating member.

8. The combination switch and multiple filament light bulb, as recited in claim 7, wherein said two conductive strips constitute an integral part of another insulating member.

9. The combination switch and multiple filament light bulb, as recited in claim 8, further comprising:

means for holding all of said members non-rotatably aligned in position and for rotatably mounting said handle relative thereto.

* * * * *